US008479794B2

(12) United States Patent
Vulpitta

(10) Patent No.: US 8,479,794 B2
(45) Date of Patent: Jul. 9, 2013

(54) LOCKING TAPE DISPENSER

(75) Inventor: Brian A. Vulpitta, Avon Lake, OH (US)

(73) Assignee: Shurtech Brands, LLC, Avon, OH (US)

( * ) Notice: Subject to any disclaimer, the term of this patent is extended or adjusted under 35 U.S.C. 154(b) by 119 days.

(21) Appl. No.: 13/166,904

(22) Filed: Jun. 23, 2011

(65) Prior Publication Data

US 2012/0325409 A1 Dec. 27, 2012

(51) Int. Cl.
*B65D 85/12* (2006.01)
*B65H 35/07* (2006.01)

(52) U.S. Cl.
USPC ..... 156/527; 156/574; 156/577

(58) Field of Classification Search
USPC ..... 156/574, 577, 526, 527, 579
See application file for complete search history.

(56) References Cited

U.S. PATENT DOCUMENTS

| | | | | |
|---|---|---|---|---|
| 4,961,525 | A | 10/1990 | Corbo et al. | |
| 5,181,983 | A * | 1/1993 | Sakai | 156/523 |
| 5,380,395 | A * | 1/1995 | Uchida | 156/577 |
| 5,468,332 | A * | 11/1995 | Dretzka et al. | 156/527 |
| 5,820,005 | A | 10/1998 | Perkitny et al. | |
| 5,861,080 | A * | 1/1999 | Yang et al. | 156/576 |
| 5,878,932 | A | 3/1999 | Huang | |
| 5,921,450 | A * | 7/1999 | Robinson | 225/56 |
| 6,672,532 | B1 | 1/2004 | Huang | |
| 6,690,070 | B2 | 2/2004 | Sekikawa et al. | |
| 6,719,180 | B2 | 4/2004 | Shah | |
| 6,874,554 | B2 | 4/2005 | Chandaria | |
| 6,913,060 | B2 | 7/2005 | Chandaria | |
| 6,923,358 | B2 | 8/2005 | Chandaria | |
| D573,645 | S | 7/2008 | Sommers et al. | |
| D588,646 | S | 3/2009 | Vulpitta | |
| D591,354 | S | 4/2009 | Vulpitta | |
| 2002/0079346 | A1 | 6/2002 | Yu | |
| 2002/0104865 | A1 | 8/2002 | Huang | |
| 2007/0158017 | A1 * | 7/2007 | Rice et al. | 156/253 |
| 2010/0084450 | A1 | 4/2010 | Vulpitta | |

* cited by examiner

*Primary Examiner* — Mark A Osele
(74) *Attorney, Agent, or Firm* — Fay Sharpe LLP

(57) ABSTRACT

A tape dispenser adapted to dispense lengths of adhesive tape from a roll of adhesive tape wound upon a cylindrical tape core having a first sidewall, a second sidewall generally parallel to the first sidewall, a hub structure and a tape retaining tab extending inwardly from at least one of the first and second sidewalls. A rearwardly extending tongue is supported between the sidewall front portions, the tongue includes a rear edge approaching the tape retaining tab and defining therewith a gap. An unwound portion of the tape passes through the gap between the retaining tab and the tongue, and the tongue is movable between a first position for holding the unwound portion of the tape against the tape retaining tab and a second position allowing the unwound portion of the tape to separate from the retaining tab.

17 Claims, 3 Drawing Sheets

LOCKING TAPE DISPENSER

BACKGROUND

Exemplary embodiments herein relate to tape dispensers and more particularly to hand-held dispensers for adhesive tape such as packaging tape and the like.

Adhesive tape is used in many applications by consumers and businesses. One type of adhesive tape is sometimes called packaging tape. Packaging tape is frequently sold as rolls of tape which is approximately two inches wide. It comes in various lengths from a few yards to 100 yards and beyond. The tape normally consists of a plastic film with an adhesive on one side. The adhesive tape is wound upon a cylindrical core, which is often made from either a cardboard or a plastic material. Consumers and businesses often use packaging tape to seal boxes. A length of the tape is removed from the roll and applied to the flaps of the box to close the box. Packaging tape is also used in other similar applications. Packaging tape comes in various colors, forms, and with various attributes. Some tapes have filaments to reinforce the tape. Other tapes have particularly clear plastic films. Other tapes have different kinds of adhesives for different applications. "Packaging tape" is used herein to mean adhesive tape having a plastic film of substantially uniform width with adhesive on one side rolled in many turns upon a core.

Packaging tapes are often used on a dispenser. Many inexpensive dispensers are available for use with packaging tape. Rolls of packaging tape are often sold on a dispenser as consumers and some small businesses find buying a roll of tape on a dispenser to be more convenient and cost effective. To be attractive to consumers, a dispenser for packaging tape should be easy to use, apply tape to a substrate reliably, cut tape from the roll of tape after application of tape, and be inexpensive. Reusability of a tape dispenser is also a positive attribute.

BRIEF DESCRIPTION

According to one aspect of the disclosure a tape dispenser adapted to dispense lengths of adhesive tape from a roll of adhesive tape wound upon a cylindrical tape core comprises a first sidewall, a second sidewall generally parallel to the first sidewall, a hub structure and a tape retaining tab extending inwardly from at least one of the first and second sidewalls, the tape core being rotatably supported on the hub structure of the first and second sidewalls, and a tongue supported between the sidewall front portions, the tongue having a surface approaching the tape retaining tab. An unwound portion of the tape passes between the surface of the tongue approaching the tape retaining tab and the retaining tab, and the tongue is movable between a first position for urging the unwound portion of the tape against the tape retaining tab and a second position not urging the unwound portion of the tape against the tape retaining tab.

More particularly, the surface of the tongue approaching the tape retaining tab can be a bottom surface of the tongue, and when the tongue is moved to the second position, the bottom surface of the tongue can be spaced farther from the tape retaining tab than when the tongue is in the first position. The tongue can be biased towards the first position. The tape retaining tab can have a tape engaging surface, and at least a portion of the bottom surface of the tongue can be no higher than 3 Mils, for example, above the tape engaging surface of the retaining tab when the tongue is in its first position. At least a portion of the bottom surface of the tongue can be above the tape engaging surface of the retaining tab when the tongue is in the second position. At least a portion of the tape engaging surface of the tape retaining tab can be curved, and the tongue can urge the unwound portion of tape against the curved portion of the tape engaging surface. A rear edge of the tongue can be displaced upwardly when tension is applied to the unwound portion of the tape during dispensing. A cutter bar can extend between and interconnect the first and second sidewalls at front portions thereof, wherein the tongue can be cantilevered and extend rearwardly from the cutter bar towards the tape retaining tab. The tongue can approach the tape retaining tab from above, and the rear edge of the tongue can be curved upwardly. The dispenser can further include a foot portion located between the hub structure and the tab on at least one of the side walls, the foot structure extending radially beyond an edge of the tape roll for supporting the tape dispenser on a surface with the tap guide in an elevated position.

In accordance with another aspect, a tape dispenser for dispensing a length of tape from an associated tape roll comprises a tape roll hub portion for supporting the associated tape roll, and a tape guide portion adjacent the tape roll hub portion adapted to retain an unwound portion of tape connected to the associated tape roll in a dispensing position and guide the unwound portion of tape during dispensing. The tape guide includes a pair of spaced apart side walls extending radially from the hub portion, the side walls defining therebetween a channel for guiding the unwound portion of tape extending from the associated tape roll when supported on the hub portion, at least one of the side walls having a tape retaining tab extending into the channel, the tape retaining tab having a tape engaging surface on which the unwound portion of tape is held prior to dispensing, and a tongue supported on at least one of the side walls, said tongue extending towards the tape engaging surface of the tape retaining tab, the tongue movable between a first position for urging the unwound portion of the tape against the tape retaining tab and a second position not urging the unwound portion of the tape against the retaining tab.

When the tongue is moved to the second position, a bottom surface of the tongue is spaced farther from the tape retaining tab than when the tongue is in the first position. The tongue can be biased towards the first position. A bottom surface of the tongue can be no higher than the tape engaging surface of the retaining tab when the tongue is in its first position. The bottom surface of the tongue can be above the tape engaging surface of the retaining tab when the tongue is in the second position. The dispenser can further include a foot portion located between the hub portion and the tape retaining tab, the foot structure extending radially beyond an edge of the hub portion for supporting the tape dispenser on a surface with the tape guide portion in an elevated position. The tape guide portion can further include a cutter bar located at a forward end of the tape guide portion extending between the side walls, and the tongue can be cantilevered and extend rearwardly from the cutter bar. At least a portion of the tape engaging surface of the tape retaining tab can be curved, and the tongue can urge the unwound portion of tape against the curved portion of the tape engaging surface. The tongue can approach the tape retaining tab from above, and a rear edge of the tongue can be curved upwardly. The dispenser can further include a pair of opposed tape retaining tabs extending inwardly from respective sidewalls, wherein the tongue approaches both tape retaining tabs.

DETAILED DESCRIPTION

Figure 1:
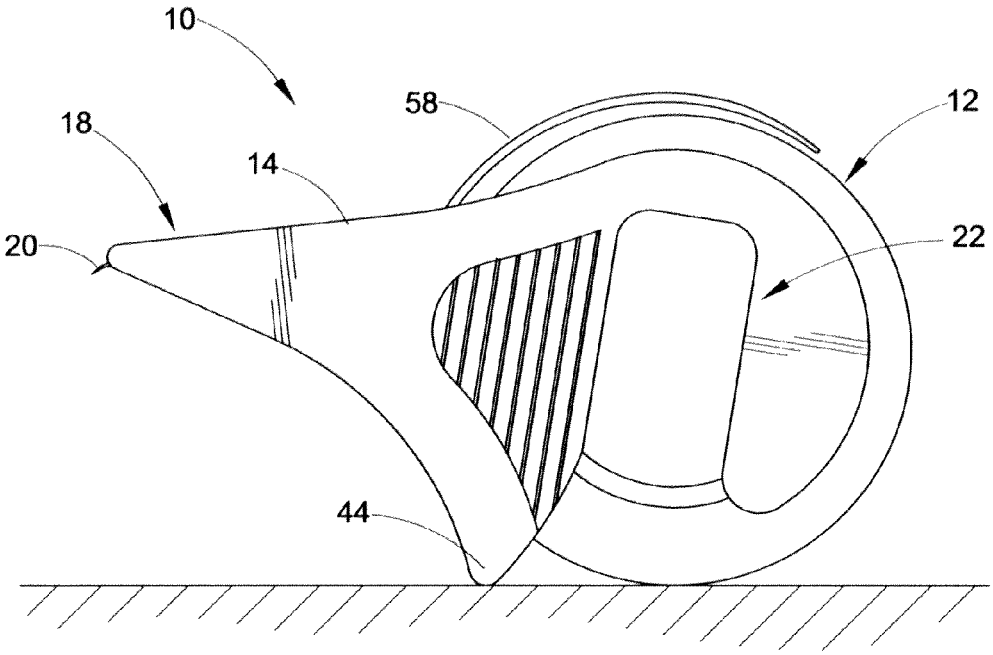
FIG. 1 is a side elevational view of an exemplary ape dispenser in accordance with the disclosure.
Figure 2:
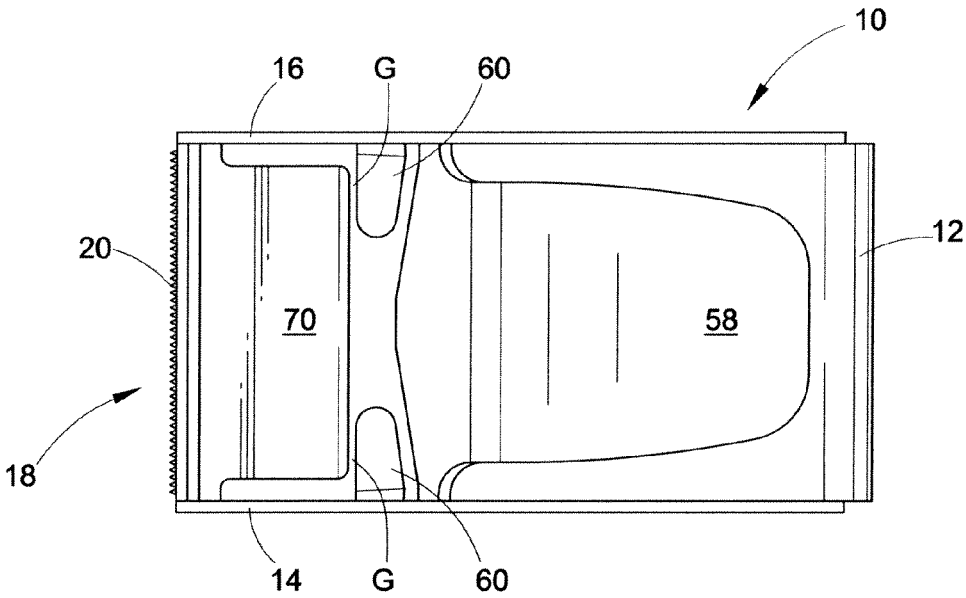
FIG. 2 is a top view of the tape dispenser of FIG. 1.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIGS. 1-4 depict an exemplary tape dispenser 10 for a roll of tape 12. The roll of tape 12 is conventional in construction and includes a cylindrical core, formed from either plastic or cardboard material, with a length of adhesive tape wound upon the core in many turns. In the depicted exemplary embodiment, a two (2) inch wide or 48 mm wide packaging tape is used. The inside diameter of the core of the depicted embodiment is 1.5 inches. A smaller or larger core can be used with the tape dispenser 10, as will be appreciated. The packaging tape used is a polypropylene film (sometimes referred to as a backing) with adhesive coated on one side of the film; although, alternative packaging tapes are contemplated.

The tape dispenser 10 in a most general description includes a hub portion that holds the roll of tape 12, and a tape guide portion for guiding tape as it is unwound from the roll 12. More specifically, the tape dispenser 10 generally comprises a left sidewall 14, a right sidewall 16 and a cutter bar 18 extending therebetween and supporting a cutter blade 20. The side walls 14 and 16 define therebetween a channel for guiding an unwound portion of tape extending from the tape roll 12 as will be described. For ease of description, the following conventions will be adopted with reference to the tape dispenser 10 as seen in the figures. Forward or front means towards a cutter blade 20. Rearward or rear means away from the cutter blade 20, e.g., opposite the front. Top or upper refers to that portion of the tape dispenser 10 or the direction of the tape dispenser toward the cutter bar 18 and away from foot portions 44 and 46. Inward means projecting from one sidewall 14/16 toward the other sidewall 14/16 of the tape dispenser 10.

Returning to the drawings, the left and right sidewalls 14 and 16 are mirror images of one another. Therefore, the description of the sidewalls will be understood with reference to each of the sidewalls 14 and 16, and portions thereof, as they are visible in the drawings. The sidewalls 14 and 16 are generally planar and each includes a hub structure 22 and 24, respectively. The hub structures 22 and 24 extend inwardly from the rear portions of the respective sidewalls 14 and 16 and comprise a generally U-shaped flange 26 (flange of sidewall 14 not visible in the drawings) which is inverted when the tape dispenser 10 is seen in the upright position of FIGS. 1, 3 and 4.

Figure 3:
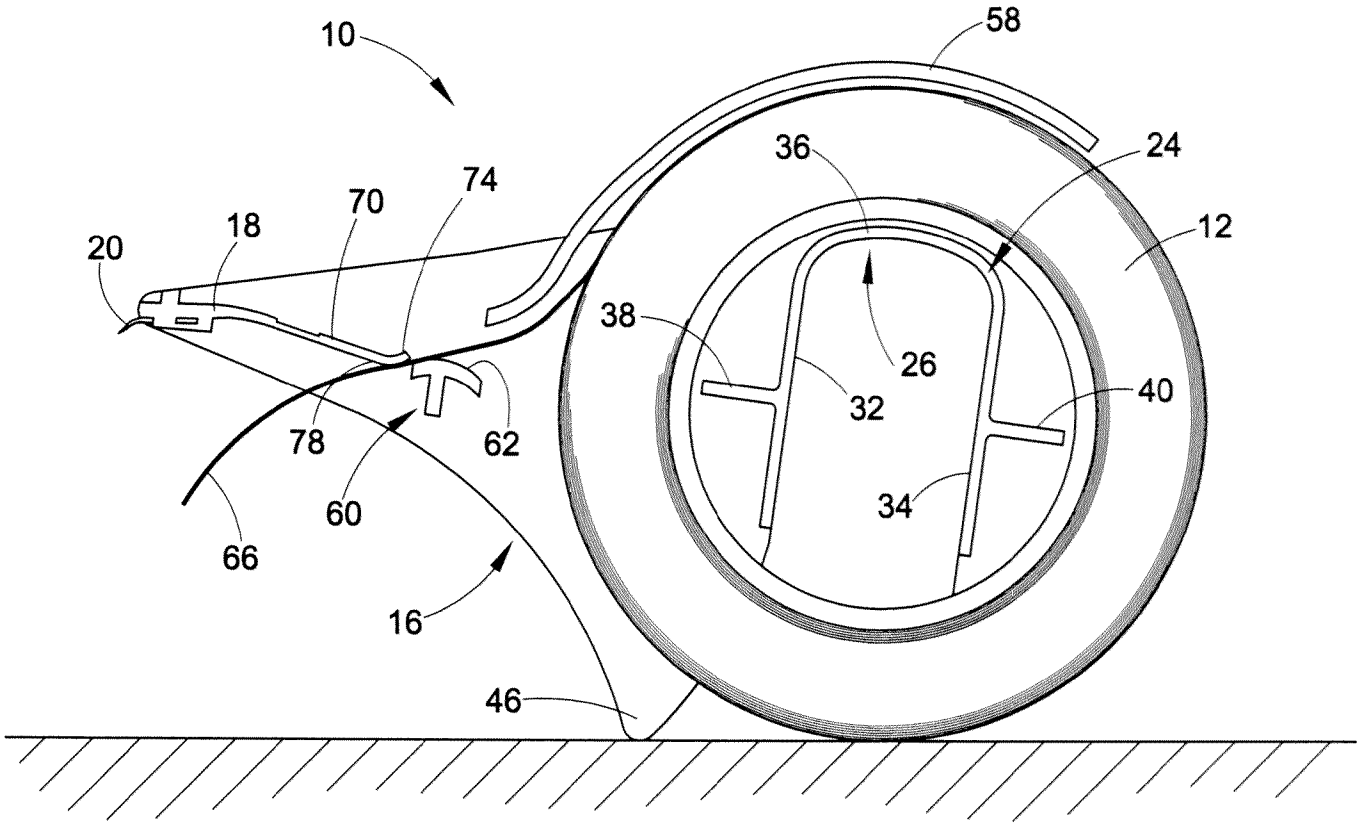
FIG. 3 is a side elevational view of the tape dispenser prior to dispensing wherein a sidewall has been removed to expose various components of the dispenser and tape roll.
Figure 4:
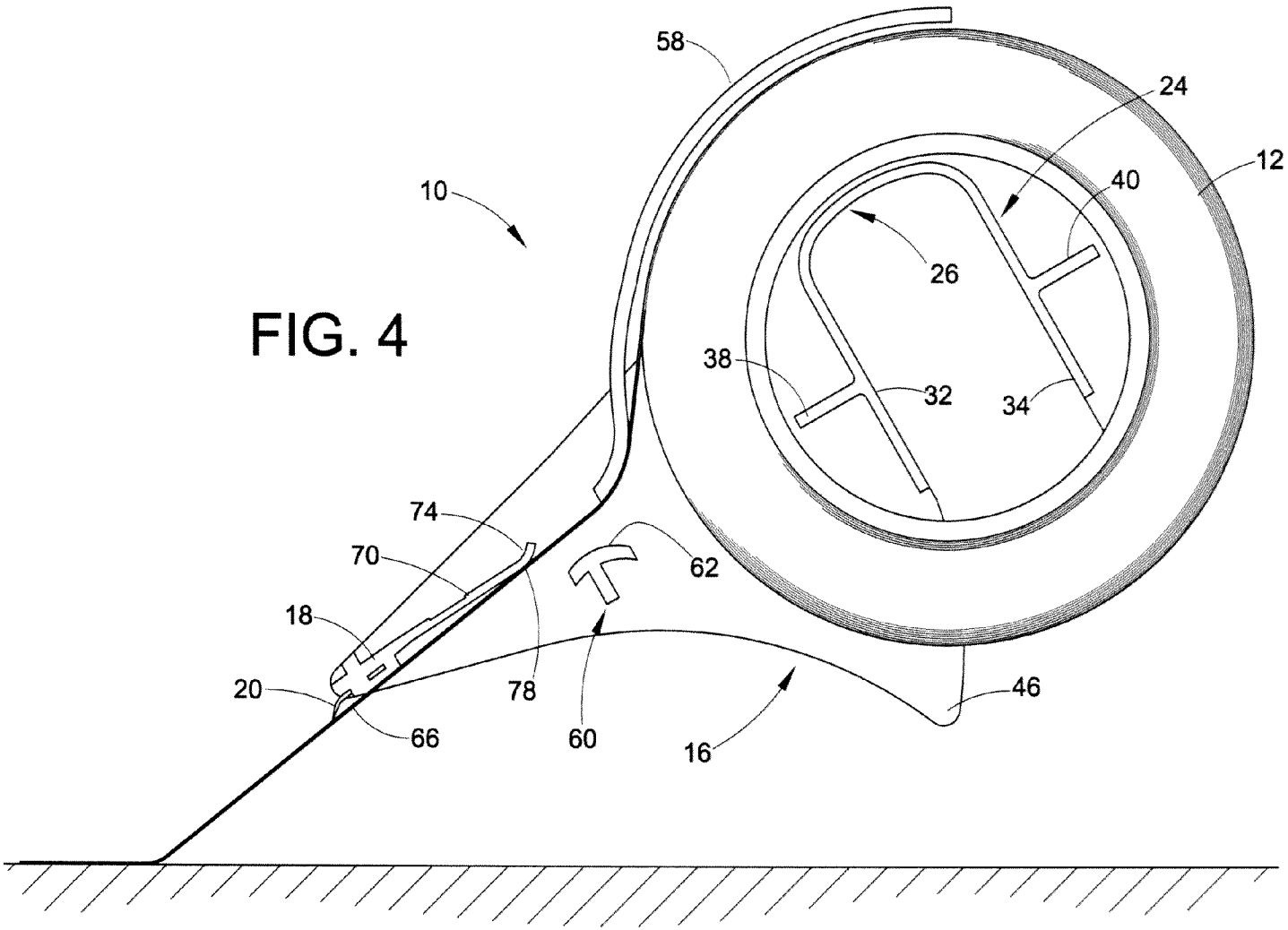
FIG. 4 is a side elevational view of the tape dispenser during a dispensing operation wherein a sidewall has been removed to expose various components of the dispenser and tape roll.

With further reference to FIGS. 3 and 4, the U-shaped flange 26 has a forward vertical leg portion 32, a rearward vertical leg portion 34 and a connecting top portion 36 having a curved shape. A forward horizontal rib 38 projects forwardly from the forward side of the forward vertical leg portion 32. A rearward horizontal rib 40 projects rearwardly from the rearward vertical leg portion 34. The horizontal ribs 38 and 40, are generally coplanar. Although not shown, the left side hub structure 22 of the left sidewall 14 is the mirror image of the right side hub structure 24.

The hub structures 22/24 are hollow within the inverted U-shaped flanges 26. This allows a user to insert a finger and thumb into the hub structures 22 while gripping the dispenser 10 and roll of tape 12. Additionally, as can be best seen in FIGS. 3 and 4, the flanges 26 with ribs 38, 40, provide good support for the interior cylindrical surface of the core of the roll of tape 12. The ribs 38, 40 are roughly on a diameter of the tape core while the connecting top portion 36 supports the top of the tape core. The bottoms of the leg portions 32, 34 prevent the tape core from riding up on the dispenser.

The roll of tape 12 is loaded by moving the left sidewall 14 away from the right sidewall 16. As the left and right sidewalls 14 and 16 are connected to the cutter bar 18 at their forward portions, moving the sidewalls away from one another at the rear end causes the hub structures 22 to move away from one another more at the rear end than at the front end. This allows for insertion of an appropriate width roll of tape without undue stress on the tape dispenser 10. The exemplary hub structures 22 are an example of one manner of connecting the roll of tape 12 to the tape dispenser 10. Different hub structures are known in the tape dispensing art. Some different hub structures, such as arc portions of an incomplete circle and other known structures, may be used without departing from the scope of the invention disclosed herein.

With continued reference to FIGS. 3 and 4, moving forward from the hub structures 22, the bottom edges of the left sidewall 14 and the right sidewall 16 extend downwardly to respective foot portions 44 and 46. The left side foot portion 44 and the right side foot portion 46 are the lowest portions of the tape dispenser 10. A bottom of each foot portion is angled upwardly toward the vertical leg portion 32 of each hub 22. The left and right sidewalls 14 and 16 have a significantly smaller height dimension forward of the right and left foot portions 44 and 46. This raises the bottom end of each sidewall 14 and 16 well above the foot portions 44 and 46. The relationship between the foot portions 44 and 46 and the roll of tape 12 can be seen best in FIG. 1. There, it is seen that the tape dispenser 10 can be placed upon a horizontal surface with the bottom of the roll of tape 12 and the foot portions 44 and 46 supporting the tape dispenser 10 and roll of tape 12 in a stable position. The advantages of this position and other structures of the tape dispenser 10 will be explained more fully hereinafter.

The tape dispenser 10 further comprises a tape roll protector/brake tongue 58 extending rearwardly over the upper curvature of the tape roll 12. A pair of tape retaining tabs 60 extend inwardly from the side walls 14 and 16. The tape retaining tabs 60 are generally opposed and extend towards each other, each of the tabs 60 having a tape engaging surface 62 (see FIGS. 3 and 4), which is a smooth, curved upper surface that is adapted to be engaged by a surface of an unwound tape portion 66 of roll 12 (also referred to herein as a leading end of the tape, or a free end of the tape) prior to dispensing a length of tape, as will be described in more detail below.

To ensure the unwound tape portion 66 of the tape roll 12 engages the tape engaging surfaces 62 of the tabs 60, a tongue 70 extends rearwardly from cutter bar 18 towards the tape retaining tabs 60 and defines therewith narrow passages or gaps G through which opposite edges of the unwound tape portion 66 pass. The tongue 70 is movable between a first position (FIG. 3) for holding or urging the edges of the unwound portion 66 of the tape roll 12 against the tape retaining tabs 60, and a second position (FIG. 4) allowing the unwound portion 66 of the tape roll 12 to separate from the retaining tabs 60. To this end, the tongue 70 is cantilevered and extends rearwardly from the cutter bar 18 towards the tape retaining tabs 66, with the rear edge 74 of the tongue 70 generally engaging the unwound tape portion 66. In the illustrated embodiment, a lower surface 78 of the tongue 70 is below the tape engaging surfaces 62 of the tabs 60 when the tongue is in the position shown in FIG. 3. This arrangement of the tongue 70 and retaining tabs 60 creates a point of inflection in the unwound tape portion 66 that tends to both secure the tape on the retaining tabs and prevent the tape roll 12 from backing up.

As shown in FIG. 3, the unwound tape portion 66 passes between the rear edge 74 of the tongue and the tape retaining tabs 60. The size of the gap G between the tongue 70 and retaining tabs 60 in the exemplary embodiment can be approximately the thickness of the tape, for example, of course a different gap size may be appropriate depending on the particular application. For example, in one embodiment the gap can be between 0.050 and 0.020 inches for accommodating tape thicknesses between 1 and 4 mils. In another embodiment, the gap G has a dimension of approximately 0.035 inches. Of course, any suitable size gap can be provided, and the disclosure is applicable to a virtually any tape thickness and/or width. In general, however, the gap size is typically less than or equal to the thickness of the tape in a given application (e.g., 1-4 Mils).

It will also be appreciated that the tongue 70 can be biased against the tabs 60 such that, when tape is not present between the tongue 70 and tabs 60, there is no gap therebetween. In such a configuration, the gap would exist only when tape passes between the tabs 60 and the tongue 70 and, due to the deflection of the tongue in such scenario, the tongue 70 would serve to bias the tape against the tabs 60. A living hinge could also be provided to allow the tongue 70 to pivot about a certain axis, for example adjacent and parallel to the cutter bar 18.

As seen in FIG. 4, the tongue 70 is resiliently deflectable from the position shown in FIG. 3 to the position shown in FIG. 4, with the natural resiliency of the tongue tending to bias it back towards the position of FIG. 3. In the position of FIG. 4, the rear edge of the tongue 70 is spaced farther from the tape retaining tabs 60 than when the tongue 70 is in the position of FIG. 3. This allows the tape to separate from the tabs 60 for dispensing.

In the rest position (FIG. 3), the tongue 70 pushes the leading end of the tape downwardly so that the portion adjacent the tape retaining tabs 60 is in engagement with the tape retaining surfaces 62 of the tape retaining tabs 60 and held in place. The forward end (e.g., free end) of the tape does not fall back upon the tape roll 12 and the tape roll 12 does not back up when the tape dispenser 10 is rested upon the surface. When one wishes to dispense tape, the dispenser 10 is grasped by placing fingers and thumbs on the outside of the sidewalls 14 and 16 and the leading end of the tape is engaged upon a substrate. The tape dispenser 10 is drawn rearwardly, which places tension upon the leading end 66 of the tape. The leading end 66 of the tape forces the tongue 70 upwardly away from the retaining tabs 70. This generally occurs because the shortest distance from the leading end 66 of the tape to the top of the roll of tape is displaced upwardly with respect to the top of the tape retaining tabs 60 and the bottom surface 78 of the tongue 70. This also disengages the leading end 66 of the tape from the tape engaging surfaces 62 of the tape retaining tabs 60 and allows the tape to move with respect to the tabs 60 and be dispensed from the roll 12.

Upon application of a desired amount of tape, the tape dispenser 10 is rotated counter clockwise to the position of FIG. 4, engaging the unwound portion of tape 66 to the cutter 20 and cutting off the selected length of tape. The new leading end 66 of tape falls downwardly from the cutter 20, the upward force on the tongue 70 is released and the leading end 66 of tape is again forced into engagement with the tape retaining tabs 60 by the tongue 70. It is then held in a position ready to commence another dispense cycle.

It will be appreciated that the present disclosure increases the holding power of the tape retaining tabs 60 to reduce the likelihood of the free end of the tape falling back onto the roll 12. This highly undesirable condition occurs, for example, when the roll of tape 12 is inadvertently rotated in a direction that tends to rewind the unwound portion of tape 66. If the unwound portion of the tape 66 is not secured sufficiently to resist the force tending to rewind the roll 12, then it may come loose and ultimately rejoin the tape on the roll 12.

In the present disclosure, this holding power is increased in at least two ways. First, the tongue 70 can apply pressure to the unwound portion of the tape 66 to help secure it to the tape retaining tabs 60. Second, the shape of the tape retaining tabs 60 increases the holding power of the tape when subjected to a shearing force, such as when a rewinding force is applied to the roll 12. The curved tape engaging surfaces 62 of the tape retaining tabs 60 provides additional holding power by ensuring that the unwound portion of the tape 66 is pulled rearwardly either in a common plane with the tape engaging surface, or from at an angle below the tape engaging surface (e.g., downwardly), thereby maintaining engagement with the tape retaining tabs 60. In prior art designs, such as those utilizing flat tape retaining tabs, the tape may be pulled rearwardly and upwardly away from the tape retaining tabs causing the tape to more easily lift from the tape engaging surface. The curved shape of the tape engaging surfaces 62 reduces of eliminates the upward lifting component thereby increasing to retention of the tap on the tape retaining tabs 60.

It will now be appreciated that the present disclosure set forth an improved tape dispenser. Although the tongue 70 in the illustrated embodiment extends rearwardly towards the tape retaining tabs 60, other configurations are possible. For example, the tongue could extend forward from a position rearward of the tape retaining tabs. In such an embodiment, the forward edge of the tongue would approach the tape retaining tabs with a bottom surface thereof being at or below the top surface of the tape retaining tabs. Such tongue would be operable in a similar manner as the tongue 70 described above.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A tape dispenser adapted to dispense lengths of adhesive tape from a roll of adhesive tape wound upon a cylindrical tape core, the tape dispenser comprising:

a first sidewall;

a second sidewall generally parallel to the first sidewall;

a hub structure and a tape retaining tab extending inwardly from at least one of the first and second sidewalls, the tape core being rotatably supported on the hub structure of the first and second sidewalls; and a cantilevered tongue supported between the sidewalls at forward portions thereof, the tongue extending in cantilevered fashion rearwardly towards the tape retainer tab and the hub structure and having a surface approaching the tape retaining tab;

wherein an unwound portion of the tape passes between the surface of the tongue approaching the tape retaining tab and the retaining tab;

wherein the tongue is movable between a first position for urging the unwound portion of the tape against the tape retaining tab and a second position not urging the unwound portion of the tape against the tape retaining tab;

wherein the surface of the tongue approaching the tape retaining tab is a bottom surface of the tongue, and when the tongue is moved to the second position, the bottom surface of the tongue is spaced farther from the tape retaining tab than when the tongue is in the first position; and wherein the bottom surface of the tongue approaches a tape engaging surface of the tape retaining tab from above, and wherein a rear edge of the tongue closest the tape retaining tab is curved upwardly such that when the tongue is in the first position, a first portion of the bottom surface of the tongue is below the tape engaging surface and a second portion of the bottom surface of the tongue is above the tape engaging surface, whereby the unwound portion of the tape passing between the tongue and the tape retaining tab is bent about both the tape engaging surface and the bottom surface of the tongue.

2. A tape dispenser as set forth in claim 1, wherein the tongue is biased towards the first position.

3. A tape dispenser as set forth in claim 1, and wherein at least a portion of a bottom surface of the tongue approaching the tape retaining tab is spaced no more than 3 Mils from the tape engaging surface of the retaining tab when the tongue is in its first position.

4. A tape dispenser as set forth in claim 3, wherein at least a portion of the bottom surface of the tongue is above the tape engaging surface of the retaining tab when the tongue is in the second position.

5. A tape dispenser as set forth in claim 3, wherein at least a portion of the tape engaging surface of the tape retaining tab is curved, and wherein the tongue urges the unwound portion of tape against the curved portion of the tape engaging surface.

6. A tape dispenser as set forth in claim 1, wherein a rear edge of the tongue closest the tape retaining tab is displaced upwardly away from the tape retaining tab when tension is applied to the unwound portion of the tape during dispensing.

7. A tape dispenser as set forth in claim 1, further comprising a cutter bar extending between and interconnecting the first and second sidewalls at the forward portions thereof, wherein the tongue is cantilevered and extends rearwardly from the cutter bar towards the tape retaining tab.

8. A tape dispenser as set forth in claim 1, further comprising a foot portion located between the hub structure and the tab on at least one of the side walls, the foot structure extending radially beyond an edge of the tape roll for supporting the tape dispenser on a surface with the tape guide in an elevated position.

9. A tape dispenser for dispensing a length of tape from an associated tape roll comprising:

a tape roll hub portion for supporting the associated tape roll;

a tape guide portion adjacent the tape roll hub portion adapted to retain an unwound portion of tape connected to the associated tape roll in a dispensing position and guide the unwound portion of tape during dispensing;

wherein the tape guide includes:

a pair of spaced apart side walls extending radially from the hub portion, the side walls defining therebetween a channel for guiding the unwound portion of tape extending from the associated tape roll when supported on the hub portion;

at least one of the side walls having a tape retaining tab extending into the channel, the tape retaining tab having a tape engaging surface on which the unwound portion of tape is held prior to dispensing; and a tongue supported on at least one of the side walls at a forward portion thereof opposite the hub portion, said tongue being cantilevered and extending rearwardly towards the tape engaging surface of the tape retaining tab and the hub portion, the tongue movable between a first position for urging the unwound portion of the tape against the tape retaining tab and a second position not urging the unwound portion of the tape against the retaining tab;

wherein at least a portion of the tape engaging surface of the tape retaining tab is curved, and a rear edge of the tongue is curved upwardly such that when the tongue is in the first position, a first portion of the bottom surface of the tongue is below the tape engaging surface and a second portion of the bottom surface of the tongue is above the tape engaging surface.

10. A tape dispenser as set forth in claim 9, wherein when the tongue is moved to the second position, a bottom surface of the tongue approaching the tape retaining tab is spaced farther from the tape retaining tab than when the tongue is in the first position.

11. A tape dispenser as set forth in claim 9, wherein the tongue is biased towards the first position.

12. A tape dispenser as set forth in claim 9, wherein the tongue has a bottom surface approaching the retaining tab, and wherein the bottom surface of the tongue is spaced no farther than 3 Mils from the tape engaging surface of the retaining tab when the tongue is in its first position.

13. A tape dispenser as set forth in claim 12, wherein the bottom surface of the tongue is above the tape engaging surface of the retaining tab when the tongue is in the second position.

14. A tape dispenser as set forth in claim 9, further comprising a foot portion located between the hub portion and the tape retaining tab, the foot structure extending radially beyond an edge of the hub portion for supporting the tape dispenser on a surface with the tape guide portion in an elevated position.

15. A tape dispenser as set forth in claim 9, wherein the tape guide portion further includes a cutter bar located at a forward end of the tape guide portion extending the side walls, and the tongue is cantilevered and extends rearwardly from the cutter bar.

16. A tape dispenser as set forth in claim 9, wherein the tongue approaches the tape retaining tab from above, and wherein a rear edge of the tongue is curved upwardly.

17. A tape dispenser as set forth in claim 9, further comprising a pair of opposed tape retaining tabs extending inwardly from respective sidewalls, wherein the tongue approaches both tape retaining tabs.

* * * * *